US010663241B2

(12) United States Patent
Baert et al.

(10) Patent No.: US 10,663,241 B2
(45) Date of Patent: May 26, 2020

(54) CANNON TURRET COMPRISING AT LEAST ONE AMMUNITION MAGAZINE, AND AMMUNITION CONTAINER FOR SUPPLYING A MAGAZINE OF SAID TYPE

(71) Applicant: NEXTER SYSTEMS, Roanne (FR)

(72) Inventors: Steve Baert, Bourges (FR); Virginie Laurent, Bourges (FR)

(73) Assignee: NEXTER SYSTEMS, Roanne (FR)

( * ) Notice: Subject to any disclaimer, the term of this patent is extended or adjusted under 35 U.S.C. 154(b) by 21 days.

(21) Appl. No.: 16/306,861

(22) PCT Filed: Jun. 1, 2017

(86) PCT No.: PCT/FR2017/051381

§ 371 (c)(1),
(2) Date: Feb. 19, 2019

(87) PCT Pub. No.: WO2017/207942

PCT Pub. Date: Dec. 7, 2017

(65) Prior Publication Data

US 2019/0264996 A1 Aug. 29, 2019

(30) Foreign Application Priority Data

Jun. 3, 2016 (FR) ..... 16 00898

(51) Int. Cl.
*F41A 9/00* (2006.01)
*F41A 9/79* (2006.01)
(Continued)

(52) U.S. Cl.
CPC ..... *F41A 9/79* (2013.01); *F41A 9/34* (2013.01); *F41A 17/38* (2013.01); *F41A 23/24* (2013.01)

(58) Field of Classification Search
CPC ..... F41A 9/79; F41A 9/34; F41A 9/56; F41A 23/24; F41A 17/38
(Continued)

(56) References Cited

U.S. PATENT DOCUMENTS 2,382,522 A * 8/1945 Trotter ..... F41A 9/04 89/33.14
2,390,013 A * 11/1945 Trotter ..... B64D 7/02 89/37.17
(Continued)

FOREIGN PATENT DOCUMENTS

DE 60 2006 000443 T2 1/2009
EP 0 129 457 A1 12/1984
GB 1 040 323 A 8/1966

OTHER PUBLICATIONS

Feb. 8, 2017 Search Report and Written Opinion issued in French Patent Application No. 1600898.
(Continued)

*Primary Examiner* — Michael D David
(74) *Attorney, Agent, or Firm* — Oliff PLC

(57) ABSTRACT

A cannon turret including a gun mount supporting a cradle that accommodates a weapon and includes trunnions pivotally mounted in sockets of the gun mount; the turret comprises an ammunition feeding device which includes at least one ammunition magazine located laterally on the cradle, below one of the sockets, and which further includes at least one feeding canal for conducting the ammunition from the magazine to the weapon. The disclosed turret is characterized in that the magazine includes at least one external canister which is secured to the gun mount and inside which at least one ammunition container can be accommodated; the canister has a rear end with an opening, and a closed front end; locking means are provided for blocking the
(Continued)

container in relation to the canister. Also, a container that is to be accommodated in a canister of the type.

13 Claims, 9 Drawing Sheets

(51) Int. Cl.
*F41A 17/38* (2006.01)
*F41A 23/24* (2006.01)
*F41A 9/34* (2006.01)

(58) Field of Classification Search
USPC ..... 89/33.14, 1.41, 34, 37.02, 37.01, 46, 89/36.13, 45
See application file for complete search history.

(56) References Cited

U.S. PATENT DOCUMENTS 2,396,073 A * 3/1946 Barnes ..... F41A 23/24 89/36.08
2,592,790 A * 4/1952 Brereton ..... F41A 9/54 89/33.05
2,649,840 A * 8/1953 Davidson, Jr. ..... F41A 9/54 89/33.16
3,788,189 A 1/1974 Sachleben, Sr. et al.
4,481,860 A * 11/1984 Schiele ..... F41A 9/04 198/800
4,481,862 A * 11/1984 Wiethoff ..... F41A 9/16 89/46
4,487,104 A * 12/1984 Schiele ..... F42B 39/22 89/34
4,494,441 A * 1/1985 Magnuson ..... F41A 9/45 89/38
4,495,853 A * 1/1985 Gottwaldt ..... F41A 9/16 89/34
4,574,685 A * 3/1986 Sanborn ..... F41A 23/34 89/36.13
4,632,011 A * 12/1986 Metz ..... F41A 9/26 89/33.4
4,686,888 A * 8/1987 Sanborn ..... F41A 23/34 89/37.13
4,690,031 A * 9/1987 Metz ..... F41A 9/26 89/33.4
4,838,144 A * 6/1989 Bierwirth ..... F41A 9/16 89/33.02
4,852,461 A * 8/1989 von Laar ..... F41A 9/375 89/46
5,131,316 A * 7/1992 Lawrence ..... F41A 9/21 89/46
5,261,310 A * 11/1993 Sullivan ..... F41A 9/21 89/46
5,267,503 A * 12/1993 Grabner ..... F41A 9/10 89/46
5,299,487 A 4/1994 Bertiller et al.
5,864,085 A * 1/1999 Begneu ..... F41A 27/08 89/37.07
6,439,098 B1 8/2002 Dillon
8,215,225 B1 * 7/2012 Zangrando ..... F41A 9/45 89/33.01
9,482,493 B2 * 11/2016 Arrighi ..... F41H 5/20
2010/0294119 A1 11/2010 Buechler et al.
2019/0310039 A1 * 10/2019 Baert ..... F41A 9/56

OTHER PUBLICATIONS

Dec. 15, 2017 International Search Report issued in International Patent Application No. PCT/FR2017/051381.
Dec. 15, 2017 Written Opinion of the International Searching Authority issued in International Patent Application No. PCT/FR2017/051381.

* cited by examiner

CANNON TURRET COMPRISING AT LEAST ONE AMMUNITION MAGAZINE, AND AMMUNITION CONTAINER FOR SUPPLYING A MAGAZINE OF SAID TYPE

The technical field of the invention is that of cannon turrets, and more particularly devices for supplying ammunition that are secured to such turrets.

Traditionally, a cannon turret comprises a gun mount bearing a cradle that receives a weapon.

The cradle pivots relative to the gun mount to allow site pointing. To that end, the cradle includes trunnions that are mounted pivoting in sockets secured to the gun mount.

The gun mount in turn will most often be mounted pivoting relative to a base secured to a vehicle or a structure. Such an arrangement allows directional angle aiming of the weapon.

The ammunition feeding device includes at least one ammunition magazine on the one hand, and at least one ammunition feeding device bringing the ammunition from the magazine toward the weapon on the other hand.

U.S. Pat. No. 5,299,487 describes such a turret that has the particularity of having four tubes and that therefore includes four ammunition magazines, each magazine being dedicated to a weapon tube.

This turret has a compact structure, the magazines are arranged laterally with respect to the cradle and are located substantially below the sockets that receive the trunnions.

This known turret, however, has the drawback of not allowing a simple resupply of the magazines with ammunition. In particular, the magazines located furthest in front of the turret cannot be supplied under protection from those serving them.

It is the aim of the invention to propose a turret whose architecture makes it possible to facilitate the resupply with ammunition quickly and in a protected manner.

The invention thus relates to a cannon turret comprising a gun mount supporting a cradle that accommodates a weapon, the cradle including trunnions pivotally mounted in sockets of the gun mount, the turret including an ammunition feeding device that on the one hand includes at least one ammunition magazine located laterally on the cradle, below one of the sockets accommodating a trunnion, and on the other hand at least one feeding canal for conducting the ammunition from the magazine to the weapon, the turret being characterized in that the magazine includes at least one external canister that is secured to the gun mount and inside which at least one ammunition container can be accommodated, the canister having a rear end with an opening, and a closed front end, locking means being provided for blocking the container in relation to the canister.

According to one embodiment, the canister may include an upper lid able to be opened and able to provide access to the upper part of at least one container and making it possible to insert or remove said container.

According to one embodiment, the canister may include a door arranged at its rear part, the door closing the opening arranged at the rear end of the canister and making it possible to introduce at least one container into the canister.

The means for locking at least one container relative to the canister may comprise, on the one hand, spacers passing through the canister and connecting two walls of the canister, and on the other hand the upper lid closing the canister.

The means for locking at least one container relative to the canister may comprise the rear door.

According to one embodiment, the turret may include at least one plate arranged behind the canister and making it possible to accommodate a container before it is introduced into the canister.

The container may advantageously be secured to the plate.

According to other features, the canister may be secured to a framework secured to a base plate, the framework including lateral bars arranged on either side of the canister and also carrying a socket intended to receive a trunnion.

The cannon turret may include two canisters secured to the framework, and arranged symmetrically on either side of a median plane perpendicular to the axis of the sockets.

The invention also relates to an ammunition container intended to equip such a cannon turret, the container being substantially parallelepiped and comprising two front walls parallel to one another and two side walls parallel to one another and perpendicular to the front walls, the front walls both having a height smaller than that of the side walls to allow the ammunition to come out in strips.

The container may include at least one roller positioned at a front wall.

The roller may be supported by a pivoting loop articulated on the side walls and forming a handle for removal and transport of the container.

The container may include a recess at the lower part of a front wall, the recess being delimited in front by a nose secured to the lower face.

The invention will be better understood upon reading the following description of one particular embodiment, the description being done in reference to the appended drawings and in which:

FIG. 1*a* is a front and perspective overview of a turret according to one embodiment of the invention;

FIG. 1*b* is an rear perspective overview of a turret according to one embodiment of the invention;

FIG. 1*c* is an rear perspective view of the turret according to one embodiment of the invention;

FIGS. 2*a*, 2*b*, 2*c* and 2*d* are several partial views showing the internal structure of the turret before mounting the cradle;

FIG. 3*a* is a perspective three-quarters view of the gun mount supporting the magazines;

FIG. 3*b* is a view similar to FIG. 3*a* and showing the containers partially removed from the right canister;

FIGS. 4*a* and 4*b* are two front perspective views of an ammunition container without a lid, FIG. 4*a* showing the container empty and FIG. 4*b* showing the container filled with ammunition;

FIG. 4*c* is a detailed sectional view of the front bottom part of the container;

FIG. 4*d* is a side transparent view of the right magazine showing the ammunition strip;

Figure 1A:
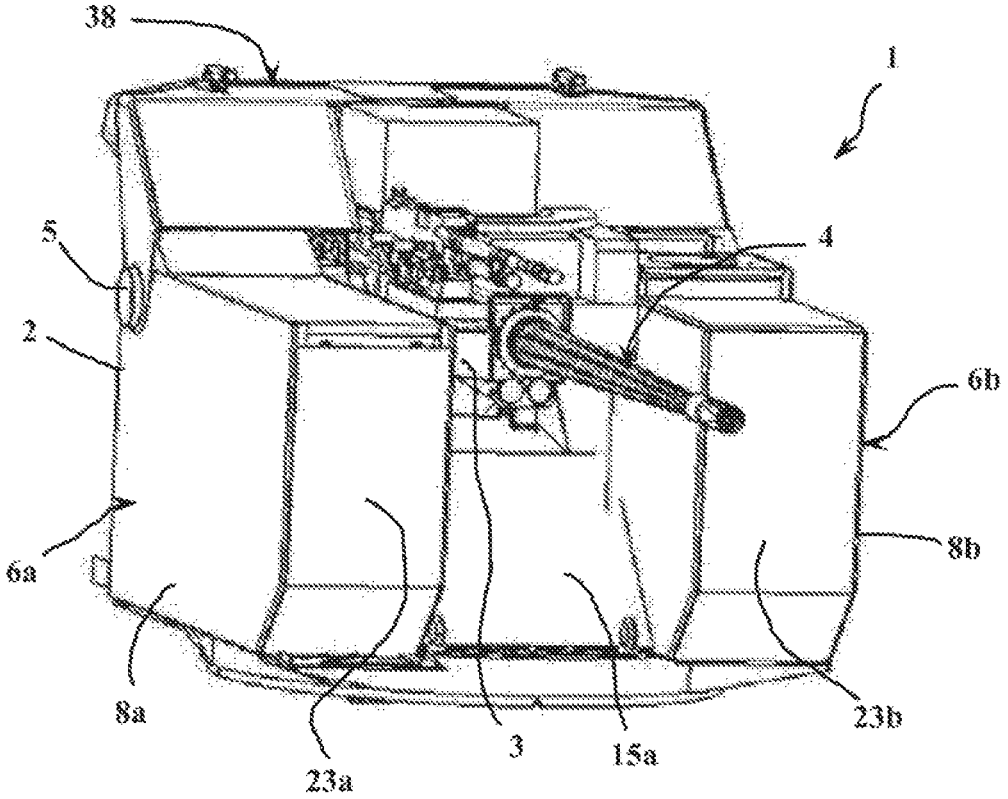
Figure 1B:
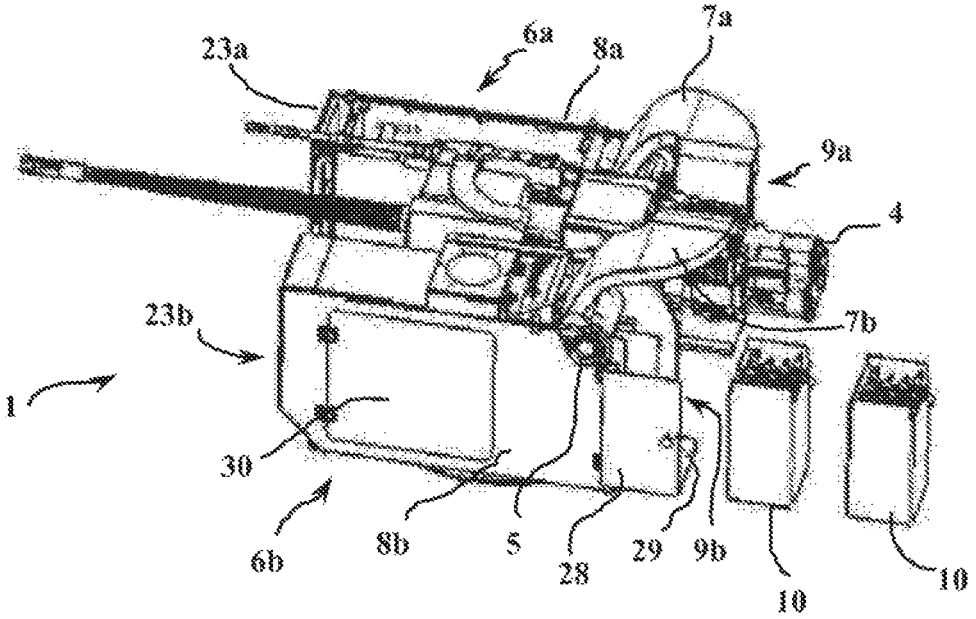
Figure 1C:
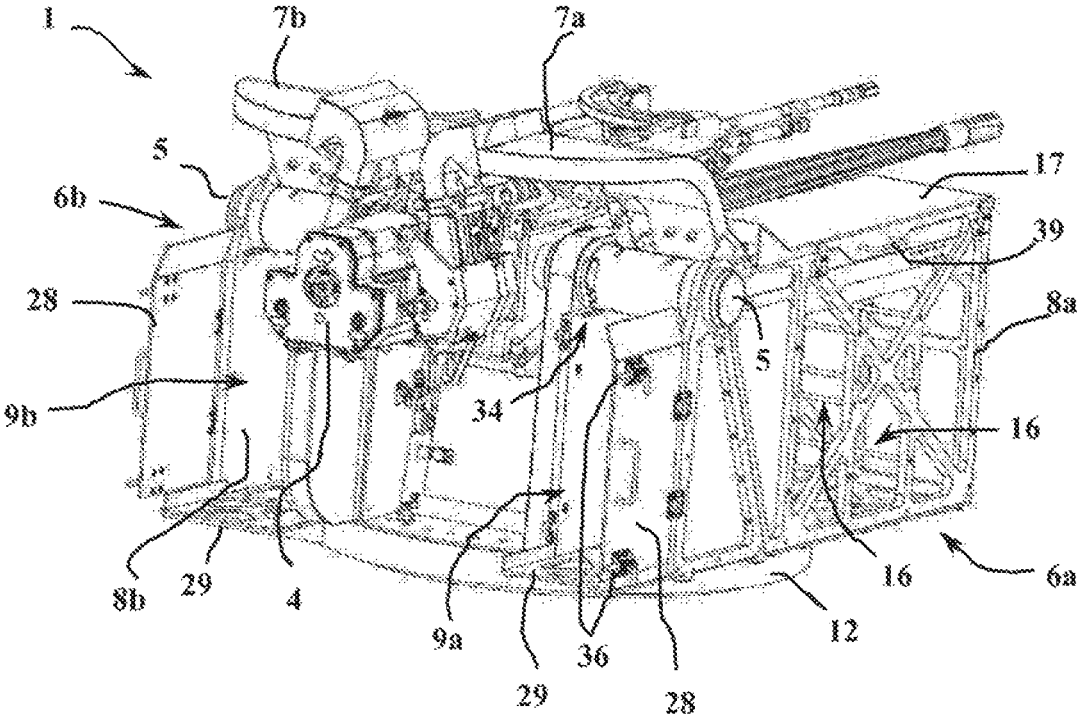

In reference to FIGS. 1*a* to 1*c*, a cannon turret 1 according to the invention comprises a gun mount 2 supporting a cradle 3 accommodating a weapon 4.

The cradle 3 includes trunnions (not shown) that are mounted pivoting in sockets 5 of the gun mount 2.

This turret 1 includes an ammunition feeding device that here includes two ammunition magazines, a right magazine 6*a* and a left magazine 6*b*.

The magazines 6*a* and 6*b* are arranged laterally with respect to the cradle and each below one of the sockets 5 receiving a trunnion.

The ammunition feeding device also includes two feeding canals 7*a* and 7*b*, which each conduct the ammunition from one of the magazines toward the weapon 4.

A right canal 7*a* conducts the ammunition coming from the right magazine 6*a*. A left canal 7*b* conducts the ammunition coming from the left magazine 6*b*. A rear cap 38 covers the canals 7*a* and 7*b*. This cap is only shown in FIG. 1*a*.

The weapon 4 here is a so-called medium-caliber weapon (caliber below 60 mm and above 12.7 mm). This weapon is defined so as to be able to fire two different types of ammunition, for example explosive ammunition and armor-piercing ammunition. The mechanics of the weapon include means for introducing ammunition making it possible to supply the weapon, as chosen, with one or the other type of ammunition. Such a weapon is for example known from patent EP 129,457

It is not the subject matter of the invention and it is therefore not necessary to describe it in detail. The invention could be carried out with a weapon including two tubes, each tube being supplied with ammunition from a separate magazine.

Each magazine 6*a* or 6*b* includes an external canister 8*a* or 8*b* that is secured to the gun mount 2 and inside which at least one ammunition container 10 may be placed (see FIG. 1*b*).

Each canister 8*a*, 8*b* includes a rear end that includes an opening (9*a* and 9*b*, respectively) and a closed front and (23*a* and 23*b*, respectively).

Locking means are provided that make it possible to immobilize each container 10 relative to its canister 8*a* or 8*b*. These locking means are described hereinafter.

Figure 2A:
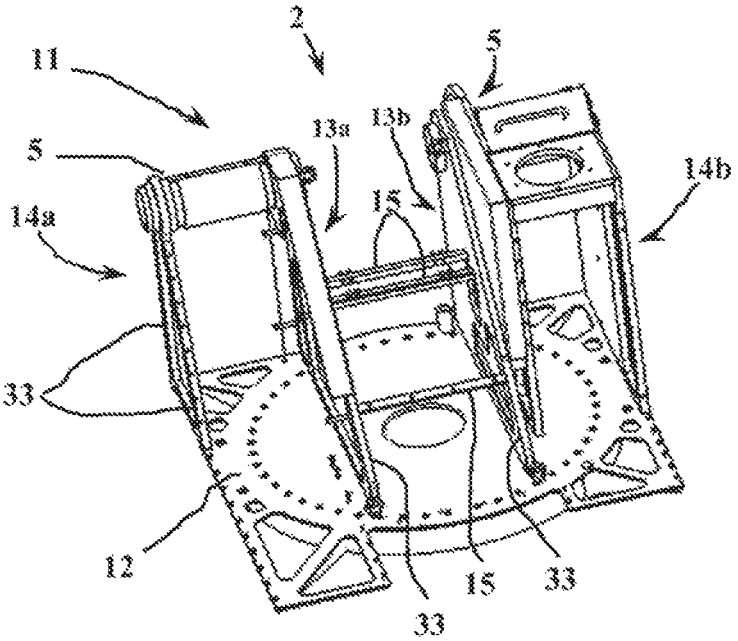
Figure 2B:
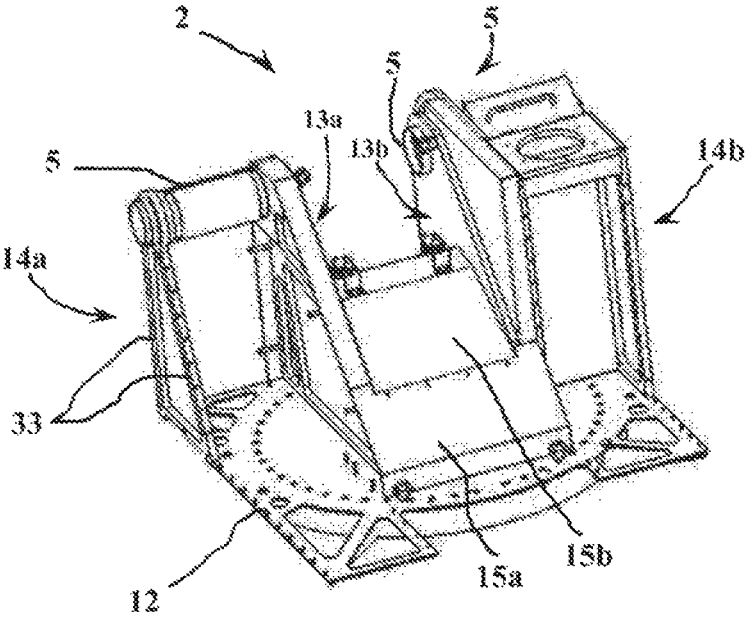
Figure 2C:
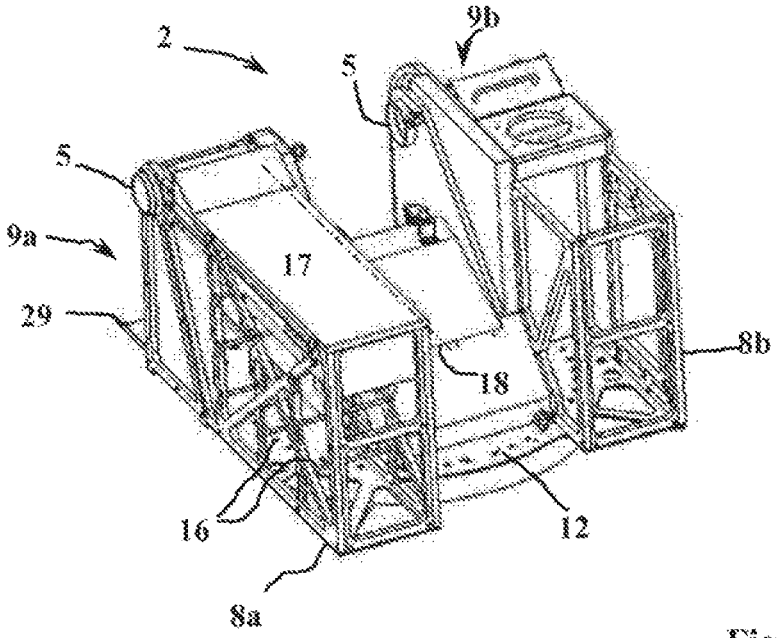
Figure 2D:
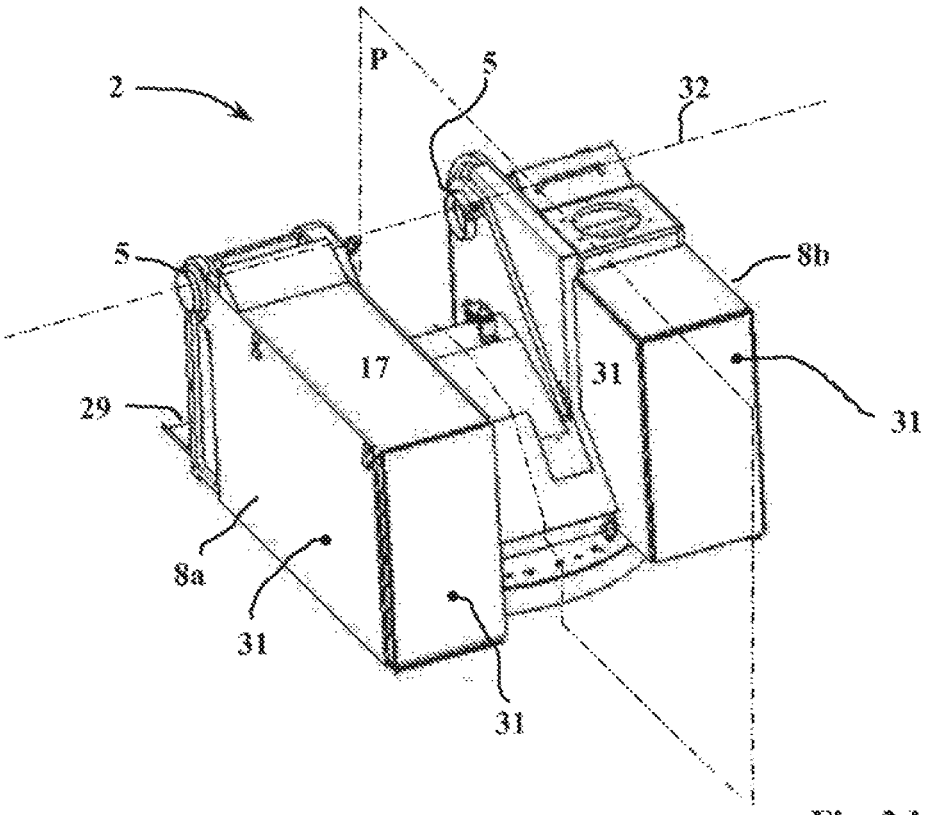

FIGS. 2*a* to 2*d* make it possible to better understand the architecture of the turret according to the invention, FIG. 2*a* showing a first step in producing the gun mount 2 and FIGS. 2*b* and 2*c* showing successive steps making it possible to produce the complete gun mount 2 as shown in FIG. 2*d*.

In FIG. 2*a*, the gun mount is formed by a framework 11 secured to a base plate 12. The framework 11 is made up of a mechanically welded assembly of bars 33 that form the fork of the gun mount 2, this assembly supporting the two sockets 5 intended to receive the trunnions of the cradle.

FIG. 2*a* shows that the side bars 33 are laterally assembled on either side of a space intended to receive the cradle of the weapon. These bars thus form two parallel vertical panels 13*a* and 13*b*, making up the fork, and each socket 5 extends perpendicular to each panel 13*a*, 13*b* toward the outside of the framework 11. The sockets 5 are supported toward the outside of the framework 11 by other lateral bars 33 that form support triangles 14*a*, 14*b* that extend, parallel to the panels 13*a* and 13*b*, from the socket 5 toward the base plate 12.

The panels 13*a* and 13*b* are also connected by spacers 15 that make it possible to stiffen the framework.

This base structure of the gun mount 2 makes it possible to design a gun mount that is both light and strong. The sockets 5 participate in stiffening the assembly and extend on either side of the fork. Between each socket 5 and the base plate 12, a space extends intended to accommodate the canister of a magazine.

As shown in FIG. 2*b*, shielding plates 15*a* and 15*b* are attached to the framework 11 between the panels 13*a* and 13*b* of the fork.

FIG. 2*c* shows the placement of the canisters 8*a* and 8*b* between each trunnion 5 and the base plate 12. It will be noted that each canister is also made in the form of a mechanically welded structure that is attached by screwing to the base plate 12. Each canister thus contributes, with a reduced mass, to stiffening the gun mount 2 by laterally reinforcing each panel 13*a* or 13*b*. The side walls of each canister are connected by spacers 16 that contribute to the stiffness of the canister and that also make it possible to separate and maintain the ammunition containers that will be arranged in the canister (see also FIG. 1*c*).

FIG. 2*c* shows an upper lid 17 that is attached to the canister 8*a* at a lateral articulation 18 that makes it possible to provide access to the upper part of at least one container once it is placed in the canister 8*a*. Here, the lid 17 provides access to the three containers that are arranged at the front of the canister 8*a*. The right canister 8*a* contains a total of five ammunition containers; three containers are introduced into the canister 8*a* through the upper opening of the canister 8*a*, after releasing the lid 17, and the other two containers are introduced into the canister 8*a* through the rear opening 9*a*, as will be described later.

The other canister 8*b* does not have a lid. Indeed, this canister is smaller and contains only two containers 10 that are introduced into the canister 8*b* through the rear opening 9*b*. The front part of this left canister 8*b* can receive the electronic control units of the weapon or the turret. They will be accessible through a side door 30 (FIG. 1*b*).

FIG. 2*d* shows the gun mount 2 after attachment of the shielding plates 31 on the side walls of the canisters 8*a* and 8*b*. These plates 31 complete the structure of the canisters 8*a*, 8*b* and protect the ammunition magazines from ballistic impacts. In FIG. 1*c*, the plates 31 are not attached to the framework 11.

Thus, at the end of the assembly, the gun mount 2 of the turret includes two canisters 8*a* and 8*b* that are secured to the framework 11, and that are arranged symmetrically on either side of a median plane P (FIG. 2*d*) perpendicular to the axis 32 of the sockets 5 receiving the trunnions (therefore also relative to the axis 32 of the trunnions).

These canisters 8*a*, 8*b* have a substantial ammunition capacity, they are shielded and they protect the ammunition. They also protect an operator implementing the weapon manually or reloading magazines from behind, as will be described hereinafter.

The framework 11 of the turret according to the invention also makes it possible to define a turret whereof the length of the canisters 8*a*, 8*b* is different, without changing the framework. Indeed, as shown in FIGS. 2*a* to 2*d*, the canisters 8*a* and 8*b* can have different lengths to receive more or fewer containers 10. The framework 11 therefore makes it possible to give a certain configurability to the architecture of the turret.

Figure 4A:
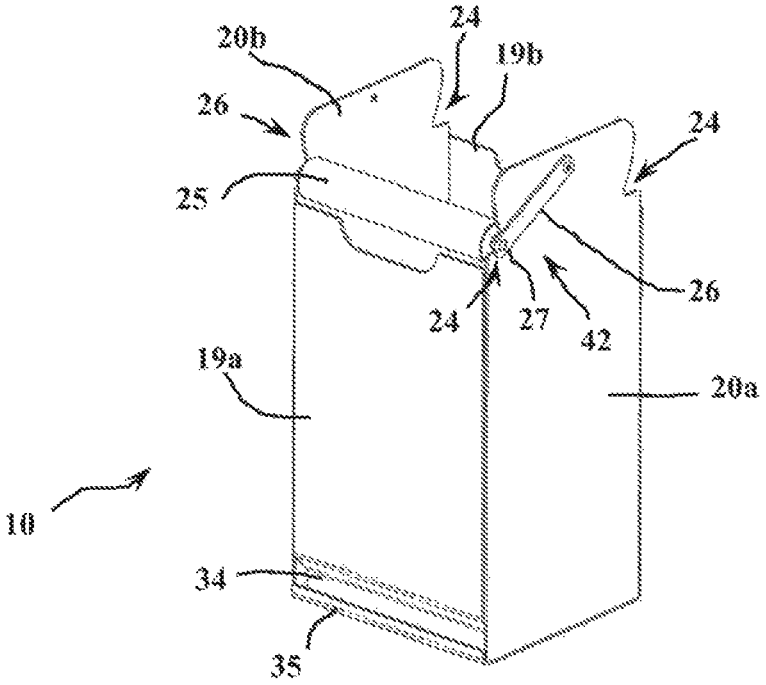
Figure 4B:
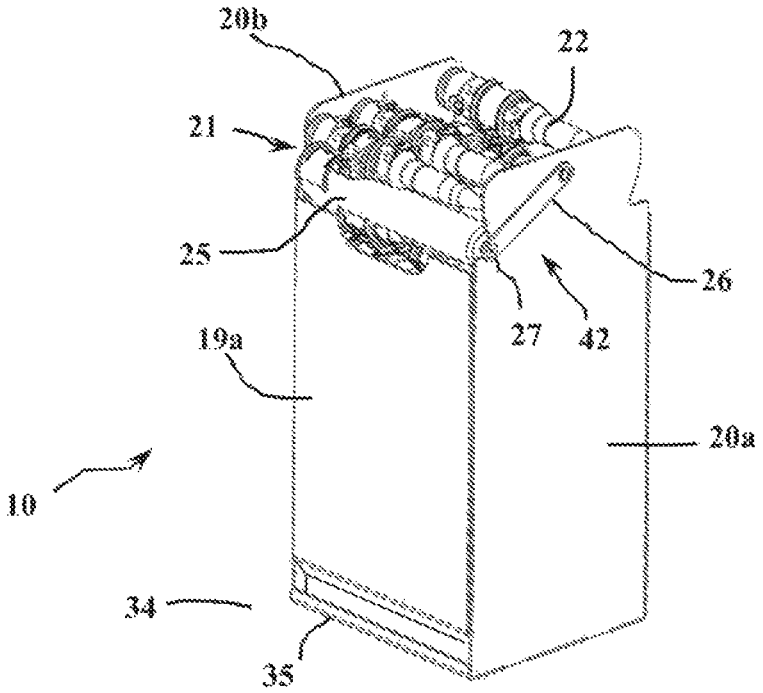

FIGS. 4*a* and 4*b* show a perspective view of a container 10 intended to be positioned in one of the canisters 8*a* or 8*b*.

This container 10 is substantially parallelepiped and comprises two front walls 19*a* and 19*b* that are parallel to one another. The container 10 also includes two side walls 20*a* and 20*b* that are parallel to one another and that are also perpendicular to the front walls 19*a* and 19*b*.

As shown in FIGS. 4*a* and 4*b*, the front walls 19*a* and 19*b* both have a height lower than that of the side walls 20*a* and 20*b*. Such an arrangement allows the strip 21 of ammunition 22 to leave the container 10 above the front walls 19*a* and 19*b*, while the strip 21 is still held transversely by the side walls 20*a* and 20*b*.

It is thus possible to connect different containers 10 to one another by connecting the different strips 21 that are contained in each container to one another. FIG. 4*d* thus schematically shows five containers $\mathbf{10}_1$, $\mathbf{10}_2$, $\mathbf{10}_3$, $\mathbf{10}_4$ and $\mathbf{10}_5$ positioned next to one another in a canister 8*a*, and the strips 21 of which are connected to one another, making it possible to feed the weapon without colliding. Closing the lid 17 of the canister 8*a* does not hinder the progression of the strip 21 from one container to the other and up to the weapon. Owing to the access to the internal volume of the canister given by the lid 17, it is possible, owing to the invention, to connect the strip 21 of one container to the other by jumping over one or several containers. Conversely, it is also possible to perform a partial replenishment of a container 10, directly from the upper part of the containers, without removing a container. This is more particularly interesting when a container is destroyed. It is then possible to connect the ammunition strip of one container to the following one while avoiding the destroyed container. It is also possible to replace the destroyed container with a new container and connect the latter to the ammunition strip, upstream and downstream from said new container.

Figure 5:
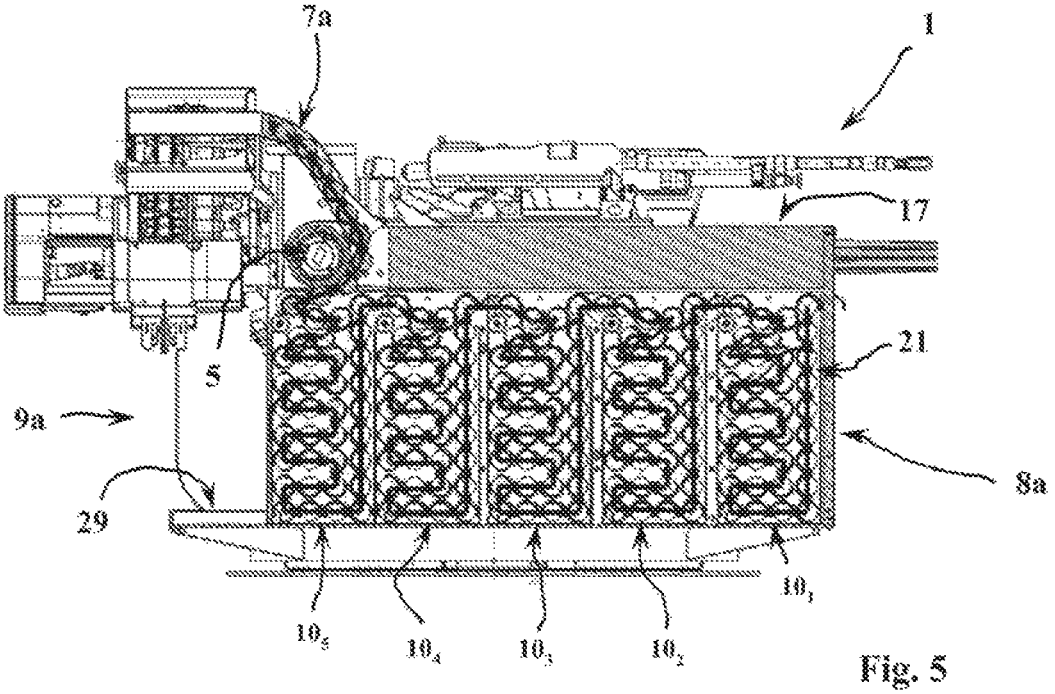
FIG. 5 is a view similar to FIG. 4*d*, but in which the magazine is secured to the turret.

As can also be seen in FIGS. 4*a* and 4*b*, the container 10 includes a roller 25 that is positioned at a front wall 19*a* or 19*b*. This roller 25 is supported by a pivoting loop 42 including two arms 26 that are articulated on the side walls 20*a* and 20*b*. The loop 42 formed by the roller 25 and the arms thus forms a handle making it possible to remove the container 10 from the canister 8*a* and to transport the container 10. When the loop is folded down, as shown in FIG. 4*a*, the axis 27 of the roller bears against an indentation 24 of each side wall 20*a*, 20*b* and the roller 25 can rotate freely on its axis 27. It is possible to provide for an assembly of the roller 25 on a needle bearing to facilitate this pivoting. The roller 25 makes it possible to guide the strip 21 between a container and its neighbor while reducing friction. Thus, as shown in FIGS. 4*d* and 5, the strip slides without roughness from one container 10 to the other.

The container 10 also includes a recess 34 at the lower part of a front wall 19*a*.

Figure 4C:
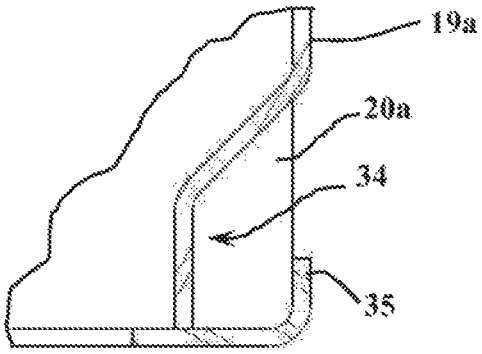
Figure 4D:
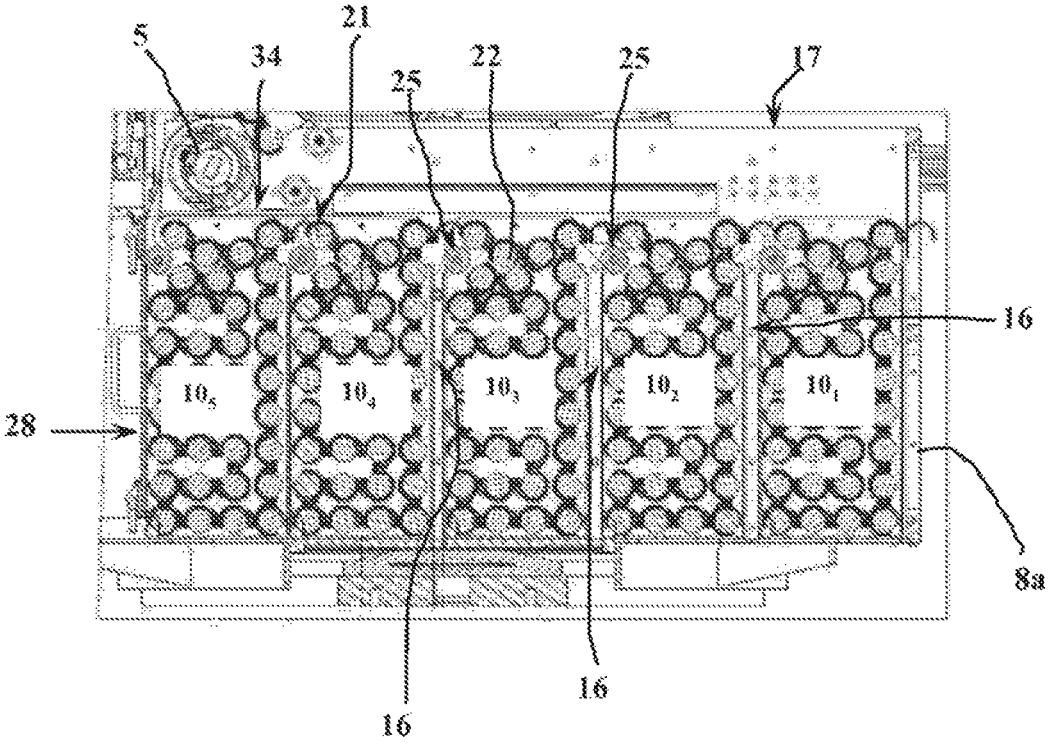

This recess 34 is more clearly visible in FIG. 4*c*. It is delimited in front by a nose 35 secured to the lower face. This nose 35 makes it possible to facilitate the manual removal of a container through the rear opening 9*a* or 9*b*.

As shown in FIGS. 1*b* and 1*c*, each canister 8*a* and 8*b* includes a door 28 that is arranged at its rear part. The door closes the opening 9*a* or 9*b* that the canister 8*a* or 8*b* includes at its rear end.

Figure 7:
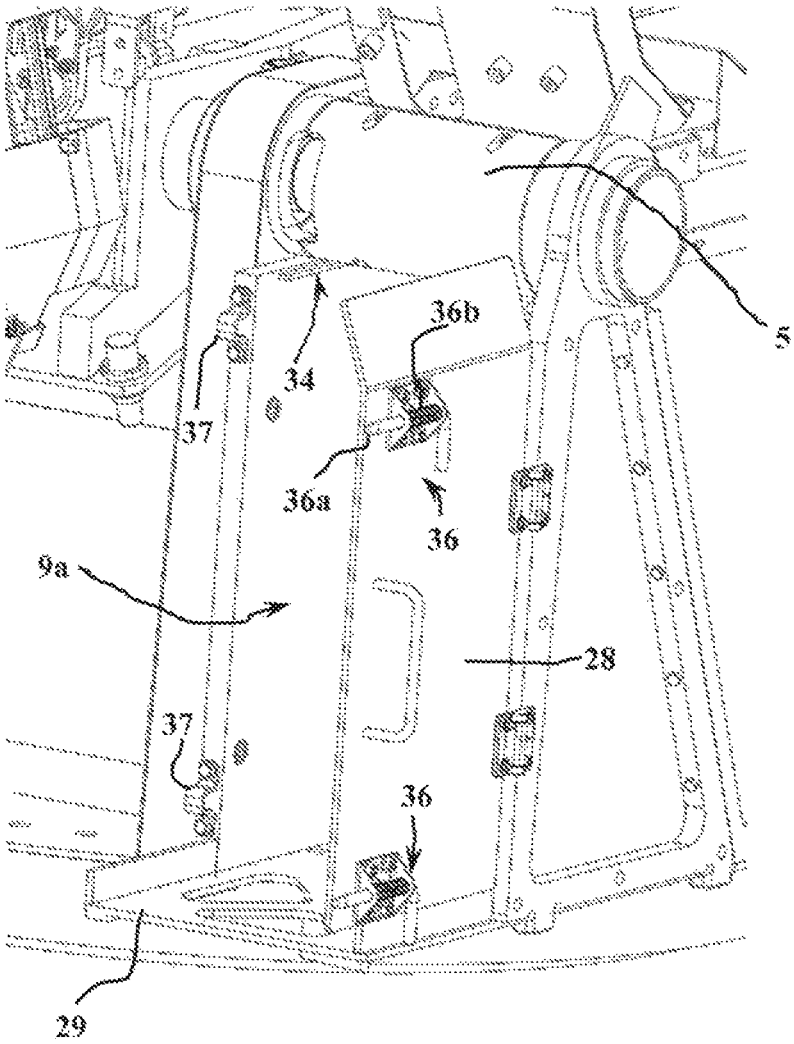
FIG. 7 is an enlarged view of a door closing the rear opening of a canister.

Furthermore, the turret includes at least one plate 29 that is arranged behind the canister 8*a* or 8*b*. This plate 29 makes it possible to receive a container 10 before it is inserted into the canister 8*a* or 8*b*. This plate 29 is more particularly visible in FIGS. 1*c* and 7.

Thus, the configuration of the turret according to the invention makes it possible to receive a relatively large number of ammunition containers with a light and compact architecture.

Figure 3A:
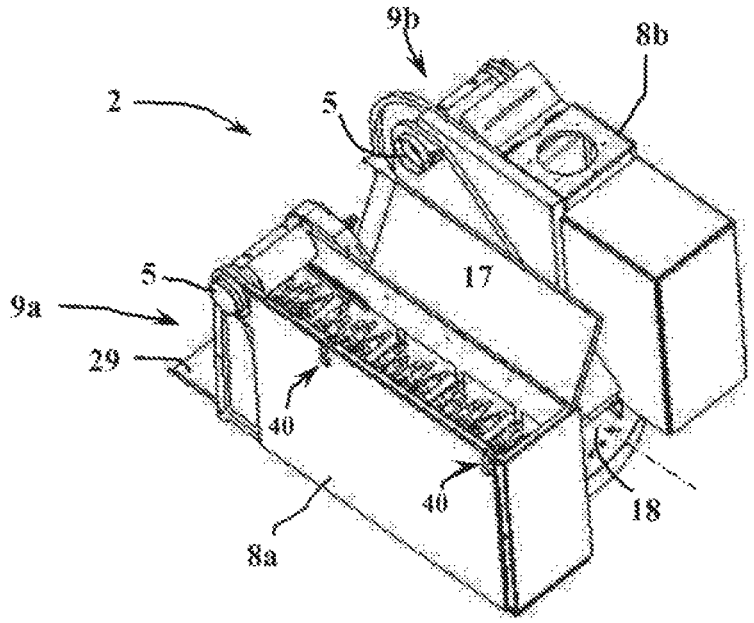
Figure 3B:
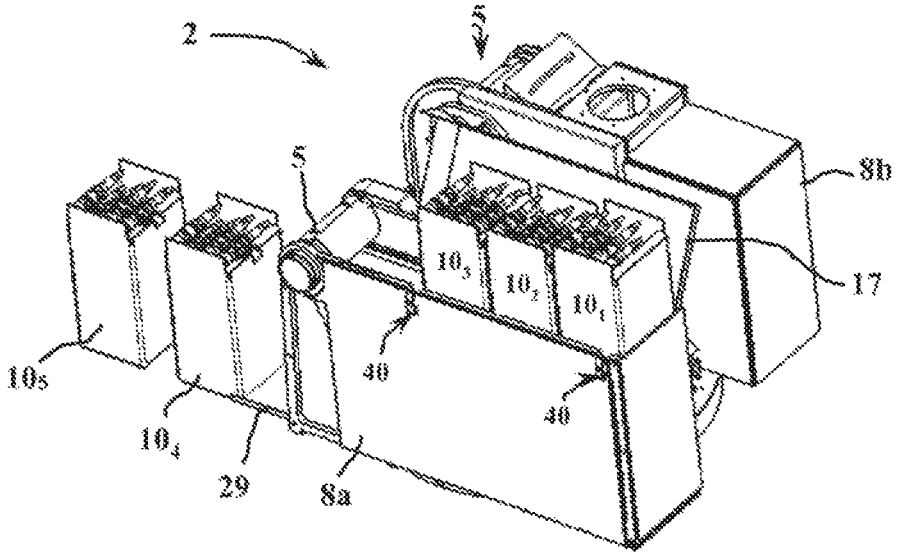

As shown in FIGS. 3*b* and 4*d*, the right container 8*a* can receive five containers 10. Three containers are inserted into the canister 8*a* through its upper opening, after pivoting the lid 17. The operator can easily connect the strips to one another to conduct the ammunition strip 21 toward a feeding star wheel (not shown) of the weapon, the star being located near the socket 5 and guiding the strip toward the canals 7*a* and 7*b* (visible in FIG. 1*b*).

The containers $\mathbf{10}_1$, $\mathbf{10}_2$ and $\mathbf{10}_3$ are held relative to the canister 8*a* by a locking means that comprises, on the one hand, the spacers 16 that pass through the canister 8*a* and connect its two side walls, and on the other hand, the upper lid 17 closing the canister 8*a*.

Figure 6:
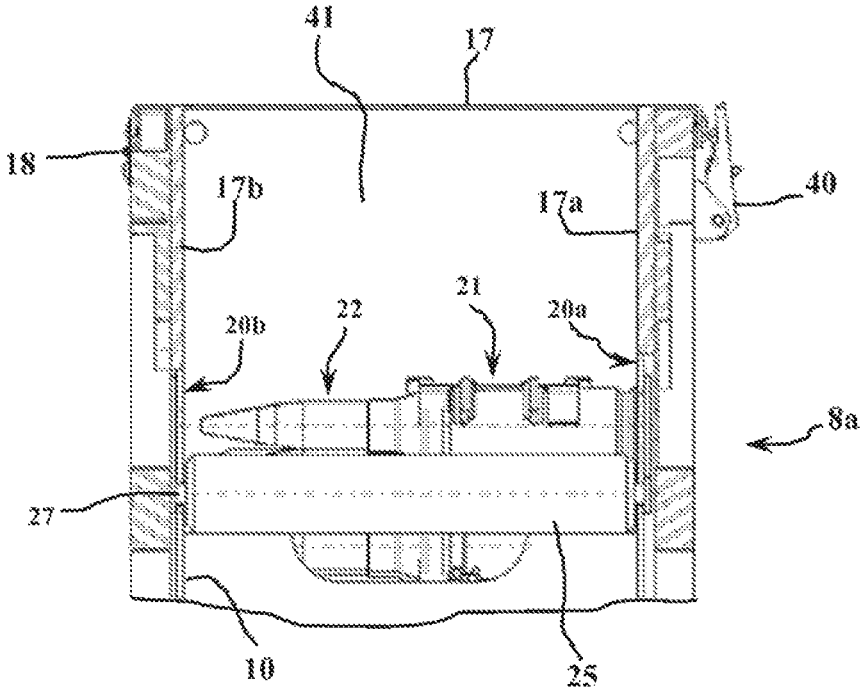
FIG. 6 is a partial sectional view of the top of a canister.

As shown more particularly in FIG. 6, the lid 17 thus includes rims 17*a* and 17*b* that block the upper edges of the side walls 20*a*, 20*b* of each container. FIG. 6 is a partial view that shows, in cross-section, the upper part of the right canister 8*a*. The sectional view is done at a roller 25 of a container 10. This figure therefore shows that the lid 17 has a U-shaped section and includes front 17*a* and rear 17*b* rims that bear against the upper edges of the side walls 20*a* and 20*b* of the body 10. Owing to these front 17*a* and rear 17*b* rims, the lid 17 thus provides immobilization of the containers 10 along a vertical direction. FIG. 6 also shows the hinge 18 of the lid 17.

The lid 17 is blocked in the closed position by knuckles 40. There are two locking knuckles 40 that are also visible in FIG. 3*b*. The lid 17 bears a handle 39 allowing it to be opened and which is only shown in FIG. 1*c*. FIG. 6 shows that the lid 17 delimits an internal volume 41 above the containers 10. This volume makes it possible to move the ammunition strip 21 without bother, from a container to its neighbor, and to the feed canals 7*a* or 7*b* of the weapon.

The rear opening 9*a* of the container 8*a* makes it possible to insert two other containers $\mathbf{10}_4$ and $\mathbf{10}_5$ into the canister 8*a*. These containers are placed by an operator located behind the turret and who is therefore protected by the shields 15*a*, 15*b*, 31 of the latter.

As shown in FIG. 5, the strips 21 of ammunition 22 that are in each container 10 are connected to one another. The connections are made after placement of the containers 10 in the canister in question. Regarding the right canister 8*a*, the strips are connected through the upper opening of the canister 8*a* before closing the lid 17.

After placing the various containers 10, there is therefore operationally a single strip of ammunition 21 that connects all of the containers 10. When one wishes to resupply the magazine 6*a*, it is possible to remove one or several containers 10 from the canister 8*a* after having opened the lid 17.

If the resupply must be done under fire from the enemy, it is possible to open the rear door 28 to access the two containers $\mathbf{10}_4$ and $\mathbf{10}_3$, which can be removed through the rear of the canister 8*a*. Such a reloading operation will be done before the entire strip 21 has been consumed. It is then easy to recover, through the rear opening 9*a*, the end of the strip 21 to reattach it to the strip of ammunition contained in the new containers.

The rear containers $\mathbf{10}_4$ and $\mathbf{10}_3$ are immobilized axially by the bearing of the container $\mathbf{10}_4$ on the container $\mathbf{10}_3$ and the bearing of the door 28 on the container $\mathbf{10}_3$, this door thus forming part of the locking means of said containers.

Furthermore, the door 28 (see FIG. 7) will include one or two bolts 36, for example bolts each including a rod 36*a* pushed by a spring 36*b* and which engages in a collar 37 (or a piercing) carried by a wall of the canister 8*a* or 8*b*. The containers $\mathbf{10}_4$ and $\mathbf{10}_3$ are immobilized transversely by the side walls of the canister 8*a* or 8*b*.

They are lastly immobilized vertically using two guide rails 34 (see FIG. 7) that are secured to each of the side walls of the canister 8*a* or 8*b*. These rails 34 form a guide means for the upper edges of the side walls 20*a* and 20*b* of the container 10 when it is inserted through the rear opening 9*a* or 9*b*.

The left canister 8*b* only contains two containers, and it is therefore always fed through the rear opening 9*b* closed by a door.

As an additional feed, it is possible to provide a sixth container (not shown, but denoted $\mathbf{10}_6$) for the canister 8*a* (or a third container for the canister 8*b*), this additional container remaining positioned on the rear plate 29 and being able to be capped by a protective lid (not shown).

The door 28 then remains open and a means will be provided for locking said additional container relative to the plate, for example a knuckle engaging in the nose 35 of the lower part of the container $\mathbf{10}_6$.

Various alternatives are possible without going beyond the scope of the invention.

It is for example possible to define a turret in which the two canisters 8*a* and 8*b* each include a lid and a certain number of containers that can be placed through the upper opening of the canister. Other containers also being placed through the rear opening.

It is also possible to design a lighter turret in which each canister 8*a* and 8*b* only includes a rear opening. The containers are then always placed through the rear of the turret. This embodiment comprises only a limited number of containers, at most three per canister.

In the turret according to the invention, the sockets 5 receiving the trunnions of the weapon extend above the canisters 8*a* and 8*b* receiving the ammunition. The trunnions may advantageously extend up to the outer end of the sockets and it is possible to attach a member (for example, a sighting means) to the end of the trunnions. The sighting means will then follow the pointing movements of the weapon. It will be advantageous to provide a removable attachment device for said sighting means, for example a cannulated shaft held by a screwed nut.

The invention claimed is:

1. A cannon turret comprising a gun mount supporting a cradle that accommodates a weapon, the cradle including trunnions pivotally mounted in sockets of the gun mount, the turret including an ammunition feeding device that on the one hand includes at least one ammunition magazine located laterally on the cradle, below one of the sockets accommodating a trunnion, and on the other hand at least one feeding canal for conducting the ammunition from the magazine to the weapon, wherein the magazine includes at least one external canister that is secured to the gun mount and inside which at least one ammunition container can be accommodated, the canister having a rear end with an opening, and a closed front end, locking means being provided for blocking the container in relation to the canister.

2. The cannon turret according to claim 1, wherein the canister includes an upper lid able to be opened and able to provide access to the upper part of at least one container and making it possible to insert or remove said container.

3. The cannon turret according to claim 1, wherein the canister includes a door arranged at its rear part, the door closing the opening arranged at the rear end of the canister and making it possible to introduce at least one container into the canister.

4. The cannon turret according to claim 2, wherein the means for locking at least one container relative to the canister comprises, on the one hand, spacers passing through the canister and connecting two walls of the canister, and on the other hand the upper lid closing the canister.

5. The cannon turret according to claim 3, wherein the means for locking at least one container relative to the canister comprise the rear door.

6. The cannon turret according to claim 1, wherein the cannon turret includes at least one plate arranged behind the canister and making it possible to accommodate a container before it is introduced into the canister.

7. The cannon turret according to claim 6, wherein the container can be secured to the plate.

8. The cannon turret according to claim 1, wherein the canister is secured to a framework secured to a base plate, the framework including lateral bars arranged on either side of the canister and also carrying a socket intended to receive a trunnion.

9. The cannon turret according to claim 8, wherein the cannon turret includes two canisters secured to the framework, and arranged symmetrically on either side of a median plane perpendicular to the axis of the sockets.

10. An ammunition container intended to equip a cannon turret according to claim 1, the container being substantially parallelepiped and comprising two front walls parallel to one another and two side walls parallel to one another and perpendicular to the front walls, the front walls both having a height smaller than that of the side walls to allow the ammunition to come out in strips.

11. The ammunition container according to claim 10, wherein the ammunition container includes at least one roller positioned at one of the front walls.

12. The ammunition container according to claim 11, wherein the roller is supported by a pivoting loop articulated on the side walls and forming a handle for removal and transport of the container.

13. The ammunition container according to claim 10, wherein the ammunition container includes a recess at a lower part of one of the front walls, the recess being delimited in front by a nose secured to a lower face.

* * * * *